US005957057A

United States Patent [19]

Nakamura et al.

[11] Patent Number: 5,957,057

[45] Date of Patent: Sep. 28, 1999

[54] RAIL SYSTEM FOR CARRIER EQUIPMENT

[75] Inventors: Jiro Nakamura, Ibaraki; Akitoshi Matsumoto, Komaki, both of Japan

[73] Assignee: Daifuku Co., Ltd., Osaka, Japan

[21] Appl. No.: 08/799,491

[22] Filed: Feb. 12, 1997

[30] Foreign Application Priority Data

Jul. 31, 1996 [JP] Japan ..... 8-200885
Jul. 31, 1996 [JP] Japan ..... 8-200886

[51] Int. Cl.[6] ..... E01B 25/22

[52] U.S. Cl. ..... 104/111; 104/106

[58] Field of Search ..... 104/89, 93, 94, 104/95, 106, 107, 109, 110, 111; 238/175, 176; 403/292, 293

[56] References Cited

U.S. PATENT DOCUMENTS

| | | | |
|---|---|---|---|
| 3,039,401 | 6/1962 | Bishop | 104/111 |
| 3,217,658 | 11/1965 | Dehne | 104/89 |
| 3,389,661 | 6/1968 | Wainwright et al. | 104/106 |
| 3,880,086 | 4/1975 | Khondker | 104/94 |
| 4,635,558 | 1/1987 | Hoehn | 104/111 |
| 5,400,717 | 3/1995 | Hoehn | 104/89 |
| 5,598,784 | 2/1997 | Kubsik et al. | 104/111 |

FOREIGN PATENT DOCUMENTS

| | | |
|---|---|---|
| 53-115586 | 9/1978 | Japan . |
| 58-044044 | 10/1983 | Japan . |

*Primary Examiner*—S. Joseph Morano
*Attorney, Agent, or Firm*—Reising, Ethington, Barnes, Kisselle, Learman & McCulloch. P.C.

[57] ABSTRACT

Connection of rails (11, 11, 15, 15) or manufacturing of yoke members can be facilitated and necessity of a special bending device can be eliminated by configuring end yoke members (21) and intermediate yoke members (20) to have the same planar plate form. Welding lines can be shortened and the rails (11, 15) can be connected speedily by welding predetermined locations of the yoke members (20, 21) to predetermined surfaces of the rails (11 and 15). By interposing intermediate members (24) filling welding margins (L) at a stage to couple the end yoke members (21) with each other by way of coupling implements (26), coupling forces are directed to act on the intermediate members (24) and not to act between end surfaces (11*b*, 11*b*) of the rails or between end yoke members which are liable to be deformed.

8 Claims, 16 Drawing Sheets

RAIL SYSTEM FOR CARRIER EQUIPMENT

FIELD OF THE INVENTION

The present invention relates to a rail system for a suspended type carrier equipment, for example, a carrier equipment used for carrying car bodies along a definite route on a ceiling in an automobile assembly shop.

BACKGROUND OF THE INVENTION

A rail system of this kind conventionally has a structure for connecting rail ends, for example, as that proposed by Japanese Utility Model Application Laid-Open No. 53-115586. Speaking concretely, this structure consists of a rail for power line which is composed of an I-shaped member and, a pair of right and left rails for a free line which are composed of C-shaped members having openings opposed to each other: these rails being bound with intermediate coupling yokes at required intervals and connected at ends thereof with connecting yokes.

The connecting yoke has, inside both lower ends thereof, integral portions which are bent so as to extend or protrude perpendicularly therefrom. In a condition where rear surfaces of the rails for the free line are kept in contact with inside surfaces of the protruding portions, they are welded by utilizing edges of the protruding portions, whereby the connecting yoke is connected to the rails for the free line with an outside surface of the connecting yoke flush with end surfaces of the rails for the free line. Further, the rail for the power line is similarly connected to the connecting yoke by utilizing a reinforcing rib plate or a similar member.

In a longitudinal direction of the rails, the ends of the rails are connected by connecting members consisting of bolts and nuts through communicating run-through slots while keeping the outside surfaces of two connecting yokes in contact with each other.

However, the conventional structure for connecting the rails ends requires two kinds of yokes: the connecting yoke having the protruding portions and an intermediate binding yoke having no protruding portions, whereby the yokes, the connecting yokes in particular, require tedious manufacturing procedures and a special device for bending the protruding portions. Further, the welding utilizing the edges of the protruding portions includes a step for welding along a long weld line in the longitudinal direction, thereby requiring a long time.

Furthermore, to connect the rails in the longitudinal direction while keeping the outside surfaces thereof in contact with each other, the rails can hardly be connected with desired precision since both the connecting yokes have been deformed due to strain produced by welding. Though the rails are subjected to stress releasing, it requires rather a long time.

In addition, a rail system of this kind has a structure for binding upper and lower rails which has a configuration disclosed, for example, by Japanese Utility Model Publication No. 58-44044. In this structure, a power rail composed of an I-shaped member, and a pair of free rails composed of C-shaped members having openings opposed to each other are disposed; these rails being bound with coupling frames at required intervals.

In the conventional binding structure for the upper and lower rails described above, however, each of the rails is connected to the coupling frames by welding and it is not easy to weld the rails while keeping a high precision. Further, the rails can hardly be connected to each other with a desired precision.

Disclosure of the Invention

It is therefore a first object of the present invention to provide a rail system for carrier equipment which is configured so that intermediate and end yoke members can be shaped in the same form having no bent portions, and welded firmly in a small number of directions and along short weld lines, and rails can be connected with high precision by utilizing the end yoke members with substantially no stress releasing.

Further, it is a second object of the present invention to provide a rail system for carrier equipment which is configured so as to permit binding upper and lower rails easily, speedily and precisely by way of the yoke members.

For accomplishing the first object described above, the present invention provides a rail system for carrier equipment which has a structure for connecting rails by way of the yoke members characterized in that the yoke member is composed of a flat plate in which slots for coupling implements are formed, the yoke members are fixed to rail ends at locations where welding margins are left within end surfaces of the rails by welding the yoke members utilizing the welding margins, and yoke members for a pair of rails having end surfaces opposed to each other are coupled by way of connecting implements passing through slots for coupling implements.

The rail system according to the present invention having the configuration described above makes it possible to configure the yoke members for connecting ends of a plurality of rails in a shape which is the same as that of yoke members for binding intermediate portions of the rails, or in a planar plate-like shape which is not bent and has slots formed at predetermined locations for passing connecting implements, thereby facilitating the manufacture of the yoke members. The rails can be coupled by way of the yoke members before they are connected. More specifically, the rails can be coupled easily, speedily and firmly by welding predetermined locations of the intermediate and end yoke members to predetermined surfaces of the rails in a small number of directions and along short weld lines. At this stage, the end yoke members can be fixed by welding at locations where welding margins are left within end surfaces of the rails.

At a stage to couple a divided rail system thus formed to another divided rail system, i.e., at a stage to couple an end yoke member to another end yoke member with the coupling implements in a condition where end surfaces of the rails are opposed to each other (in contact with each other), the end yokes can be coupled by way of the coupling implements passing through the slots formed therefor with intermediate members interposed at predetermined locations between outside surfaces of the end yoke members. Since the intermediate members which fill the welding margins are interposed between the outside end surfaces of the end yoke members, coupling forces of the coupling implements act on the intermediate member or do not act on the end surfaces of the rails and the end yoke members which are liable to be deformed, thereby making it possible to easily, speedily and precisely connect the rails by way of the end yoke members and the coupling implements with substantially no stress releasing.

A first preferable embodiment of the present invention is characterized in that it uses washers welded to the yoke members as the intermediate members filling the welding margins.

The first embodiment allows the coupling forces of the coupling implements to act locally on the yoke member through the washers welded to the predetermined locations of the yoke member.

A second preferable embodiment of the present invention is characterized in that it uses, as the intermediate members filling the welding margins, spacers which are disposed between the yoke members and fill welding margins on both sides.

The second embodiment permits the spacers being interposed in a free condition between the end yoke members at a stage to couple the end yoke members with the coupling implements and allows the coupling forces of the coupling implements to act locally on the end yoke member through a spacer which are thick enough to fill the welding margins and disposed at each coupling location.

A third preferable embodiment of the present invention is characterized in that a plurality of slots for coupling implements are formed in the yoke members, and a plurality of intermediate members are thick enough to fill welding margins on both sides and welded to one of the yoke members.

The third embodiment permits, at a stage to couple the end yoke members, the intermediate members to be interposed between the end yoke members in a condition where they are welded to either of the end yoke members, and allows coupling forces of the coupling implements to act locally on the end yoke members by way of a spacer thick enough to fill both the welding margins and disposed at each coupling location.

Further, a fourth preferable embodiment of the present invention is characterized in that a plurality of slots for coupling implements are formed in the yoke member, and a plurality of intermediate members are thick enough to fill welding margins on both sides and welded to either of the two yoke members.

The fourth embodiment allows, at a stage to couple the yoke members with the coupling implements, the intermediate members to be interposed between the end yoke members in a condition where the intermediate members are welded collectively to either one of the yoke members and a coupling force of the coupling implement acts locally on the end yoke members through a spacer thick enough to fill both the welding margins and disposed at each coupling location.

Furthermore, a fifth preferable embodiment of the present invention is characterized in that it comprises a first rail which supports and guides a driving body using a chain for imparting a moving force to a moving body and second rails which support and guide the moving body, and that the yoke members couple the rails.

The fifth embodiment allows the first rail to be coupled with the second rails by way of a plurality of yoke members and is capable of moving the moving body along a definite route with the moving force produced by the driving body at an operation stage after completing predetermined assembly. At this stage, the moving body can move stably along the definite route while being supported and guided by the second rails, and the driving body can move smoothly while being supported and guided by the first rail.

Moreover, a sixth preferable embodiment of the present invention is characterized in that a first rail is composed of an I-shaped member disposed at a higher location and second rails are composed of a pair of C-shaped members which are disposed at lower locations and have openings opposed to each other.

The sixth embodiment permits lower edges of upper middle plate portions of intermediate and end yoke members being welded to a top surface of the first rail and allows their lower inside edges of side plate portions to be welded to outside surfaces of the second rails, thereby making it possible to connect the rails easily and speedily, and provide a suspended type carrier equipment having rails connected with high precision.

In addition, a seventh preferable embodiment of the present invention is characterized in that second rails are composed of a pair of C-shaped members which are disposed at lower locations and have openings opposed to each other, and that yoke members have inwardly protruding portions which are brought into contact with top surfaces of second rails.

The seventh embodiment which adopts the configuration comprising the additional protruding portions allows the intermediate and end yoke members to be brought into contact with the second rails in two directions and for longer distances, thereby coupling the intermediate and end yoke members with the second rails with higher strength.

For accomplishing the second object described above, the rail system for carrier equipment according to the present invention comprises an upper rail, a pair of lower rails and gate-shaped yoke members disposed at predetermined locations for connecting the rails, characterized in that the upper rail is coupled with the yoke members by way of bolts studded on a top surface of the upper rail and the lower rails are coupled with the yoke members by way of fixing implements passing through the lower rails.

In the configuration described above, bolts are studded at predetermined locations on a top plate portion of the upper rail, slots for the fixing implements are formed at predetermined locations in side plate portions of the lower rails, and slots for the stud bolts and the fixing implements are formed at predetermined locations in coupling pieces of the yoke members before assembling the rail system. For assembling the rail system, the upper rail can be coupled by passing stud bolts from underside through the slots formed in the yoke members and screwing nuts over protruding portions of the stud bolts, and the lower rails can be coupled by communicating the slots formed in the lower rails with those formed in the yoke members and activating the fixing implements.

At this stage, the rails can be connected easily and speedily by way of the yoke members by screwing the nuts. In addition, the bolts can be studded on the upper rail, the slots can be formed in the lower rails and the yoke members with high precision while handling each members on the ground, whereby the rail system can be assembled with high precision.

The first preferable embodiment of the present invention is characterized in that an upper coupling piece and a pair of right and left lower coupling pieces are formed integrally with a yoke member in the longitudinal direction of the rails, an upper rail is coupled with the upper coupling piece, and lower rails are coupled with the lower coupling pieces.

In the first embodiment, the yoke member can be formed as an integral member by bending the upper and lower coupling pieces. The upper rail can be coupled with the yoke member by way of the stud bolts and the upper coupling piece, and the right and left lower rails can be coupled with the yoke member by way of fixing implements and the lower coupling pieces. Further, each of the coupling pieces can be bent or shaped over the yoke member precisely while handling each yoke member on the ground.

The second preferable embodiment of the present invention is characterized in that an upper coupling member and a pair of lower coupling members are fixed to a yoke member by way of fixing implements, an upper rail is coupled with the upper coupling member by way of stud bolts, and lower rails are coupled with the lower coupling members by way of fixing implements.

In the second embodiment wherein the rails are fixed to the yoke members by way of the upper and lower coupling members, the yoke members can have a simple form and the coupling members can be coupled with the yoke member easily and speedily by way, for example, of fixing implements consisting of bolts and nuts.

The third preferable embodiment of the present invention is characterized in that position adjusting members are interposed at required locations between the upper rail and the yoke member, and between lower rails and the yoke member.

In the third embodiment, a vertical spacing between the upper rail and the lower rails as well as a horizontal spacing between the lower rails can be adjusted with high precision by interposing the position adjusting members having a required length (or in a required quantity) at an assembly stage of the rail system, thereby making it possible to assemble the rails with higher precision by way of the yoke members.

The fourth preferable embodiment of the present invention is characterized in that a carrier equipment is so constructed that a moving body is supported and guided by the lower rails, and a driving body using a chain for supplying a moving force to the moving body is supported and guided by an upper rail.

In the fourth embodiment, the moving body can move along a definite route while receiving a moving force from the driving body at an operation stage after completing predetermined assembly of the rail system and incorporation of the carrier equipment. The fourth embodiment makes it possible to prevent the moving body from being brought into contact with exposed portions of the fixing implements due to swing and move it stably along the definite route since the moving body is supported and guided while being fitted between the lower rails. Further, the driving body can move smooth without bringing its rollers into contact with other members such as coupling means even if the driving body vibrates (or swings) within a restricted range while it is moving in the condition where it is supported and guided by the upper rail since stud bolts which are not exposed inside are used as coupling means for the upper rail.

The fifth preferable embodiment of the present invention is characterized in that an upper rail is composed of an I-shaped member and a pair of lower rails are composed of C-shaped members having openings opposed to each other.

The fifth embodiment makes it possible to assemble a most preferable rail system for carrier equipment with high precision.

EMBODIMENTS

Figure 1:
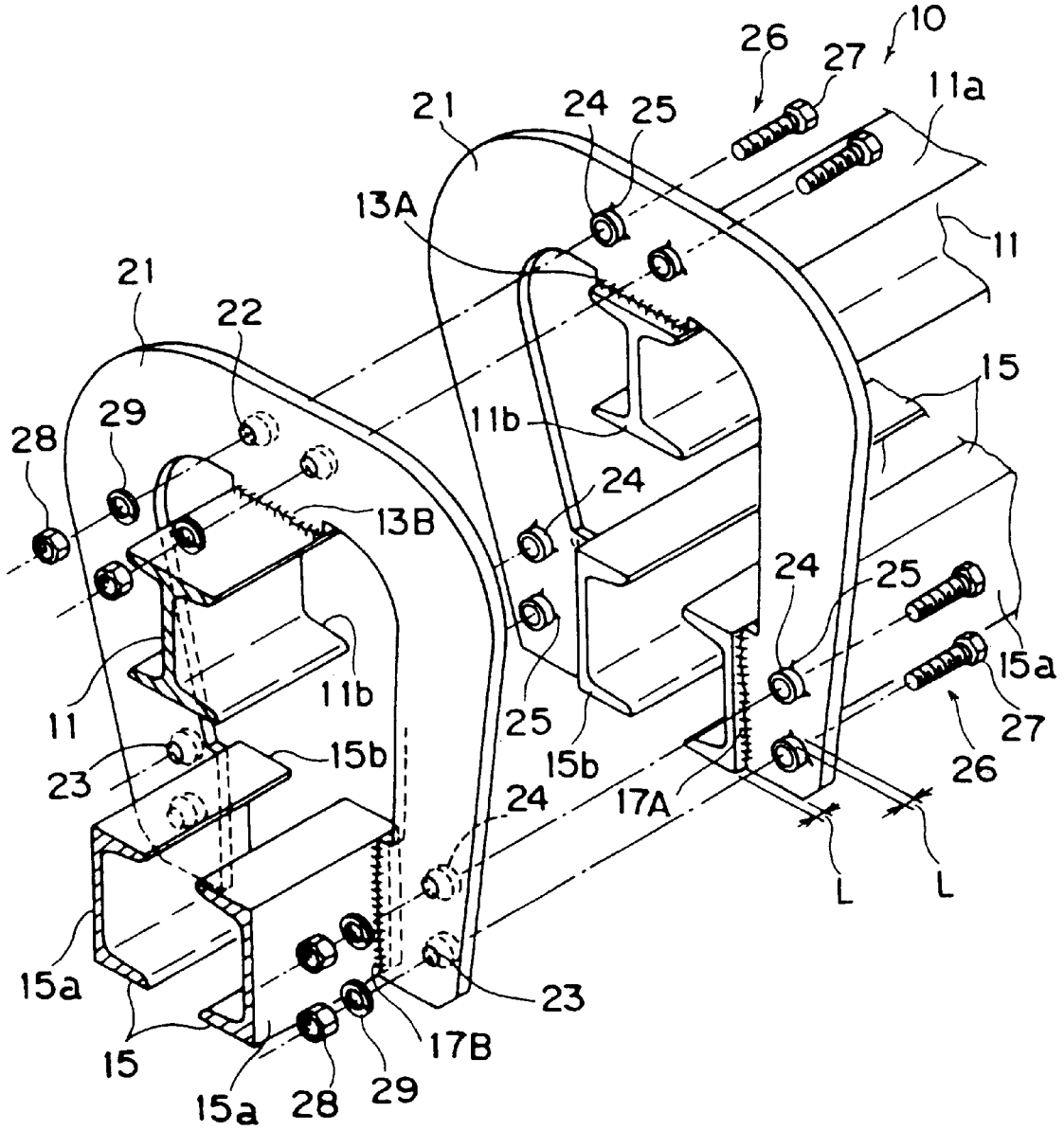
FIG. 1 is a perspective view illustrating a first embodiment of the rail system for carrier equipment in a condition where main members are not coupled.
Figure 2:
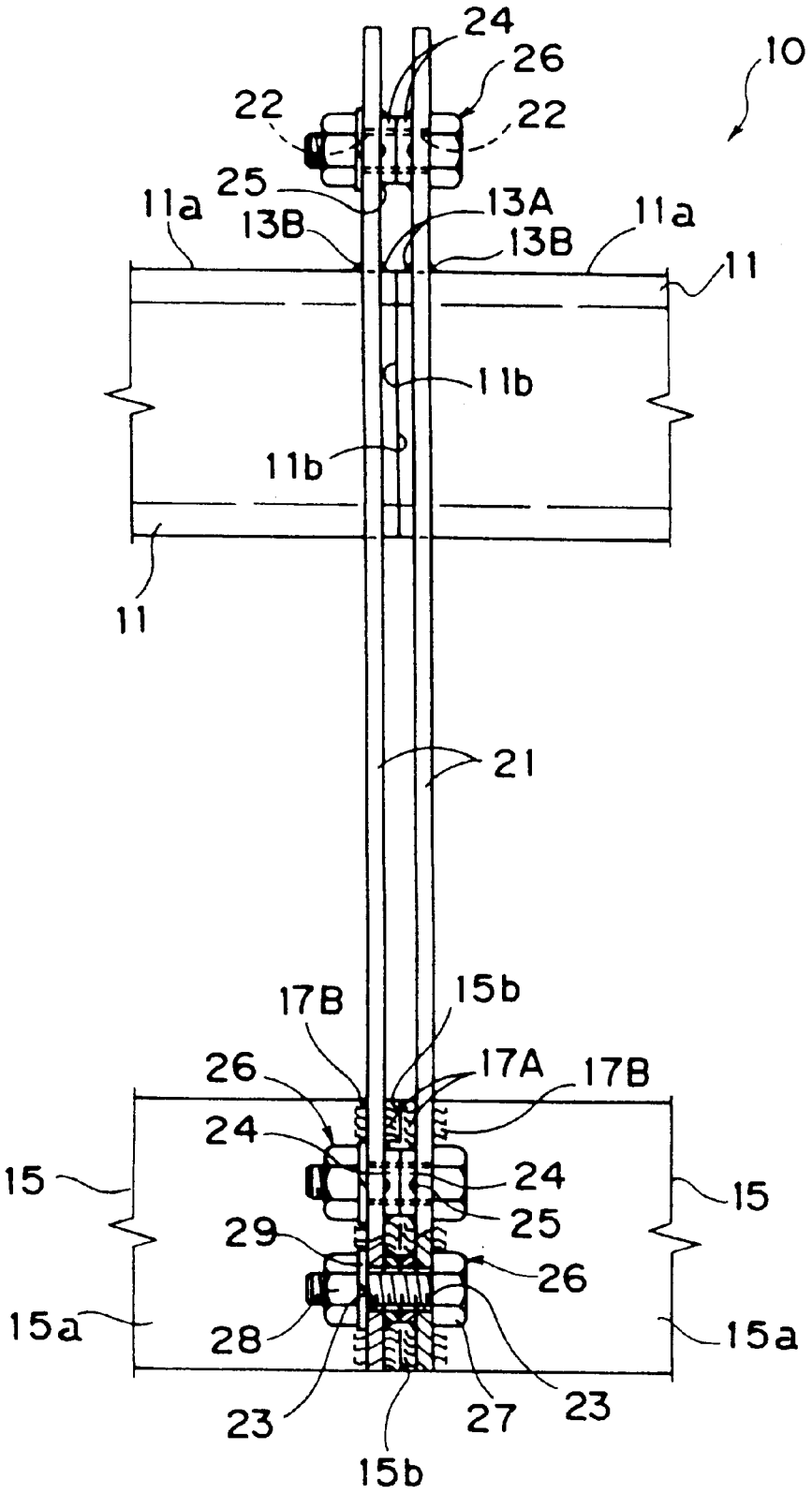
FIG. 2 is a partially cut side view illustrating the rail system for carrier equipment shown in FIG. 1 in a condition where the main members are coupled.
Figure 3:
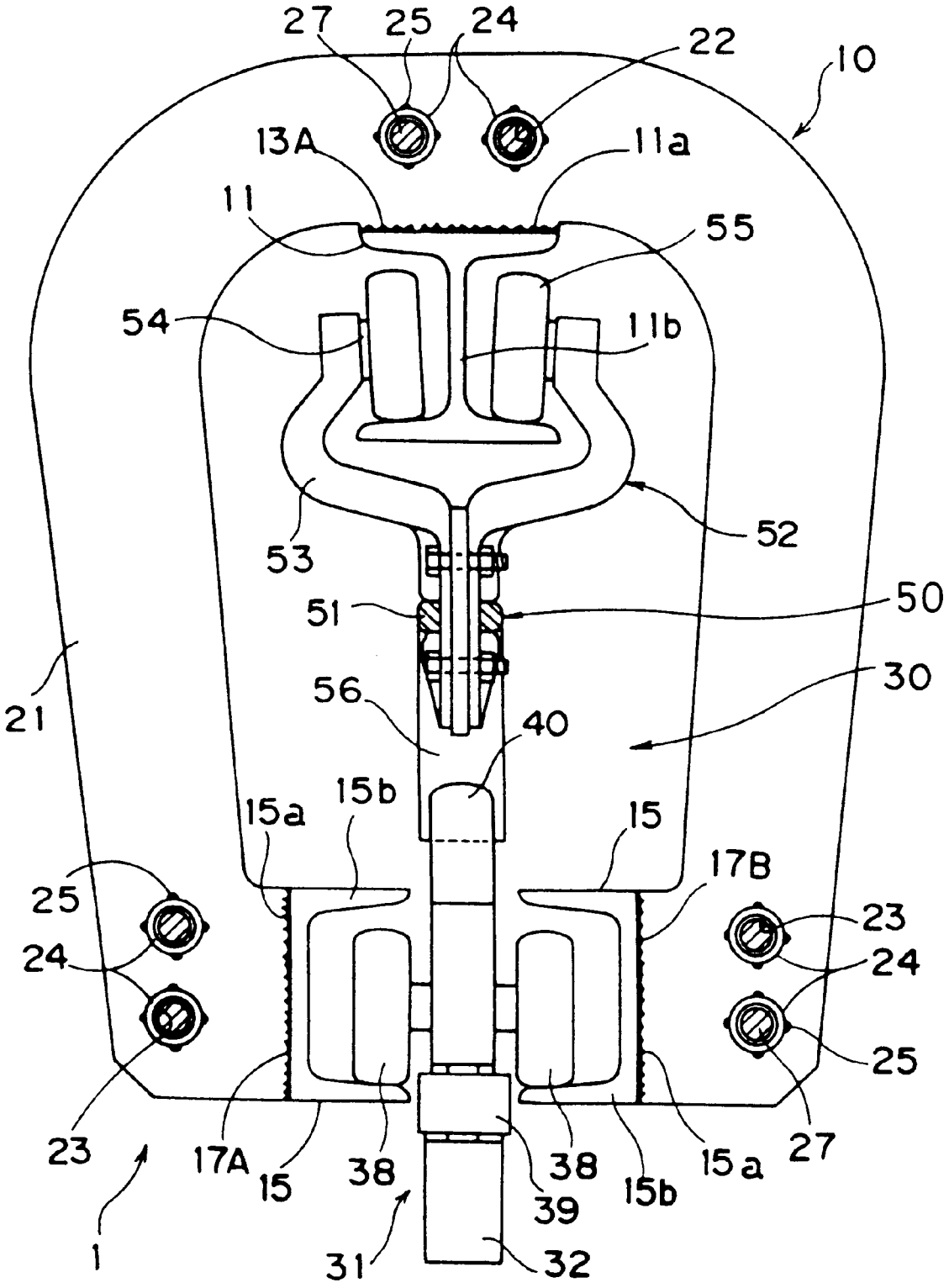
FIG. 3 is a vertical sectional front view illustrating the rail system for carrier equipment shown in FIG. 1 in a condition where the main members are coupled.
Figure 4:
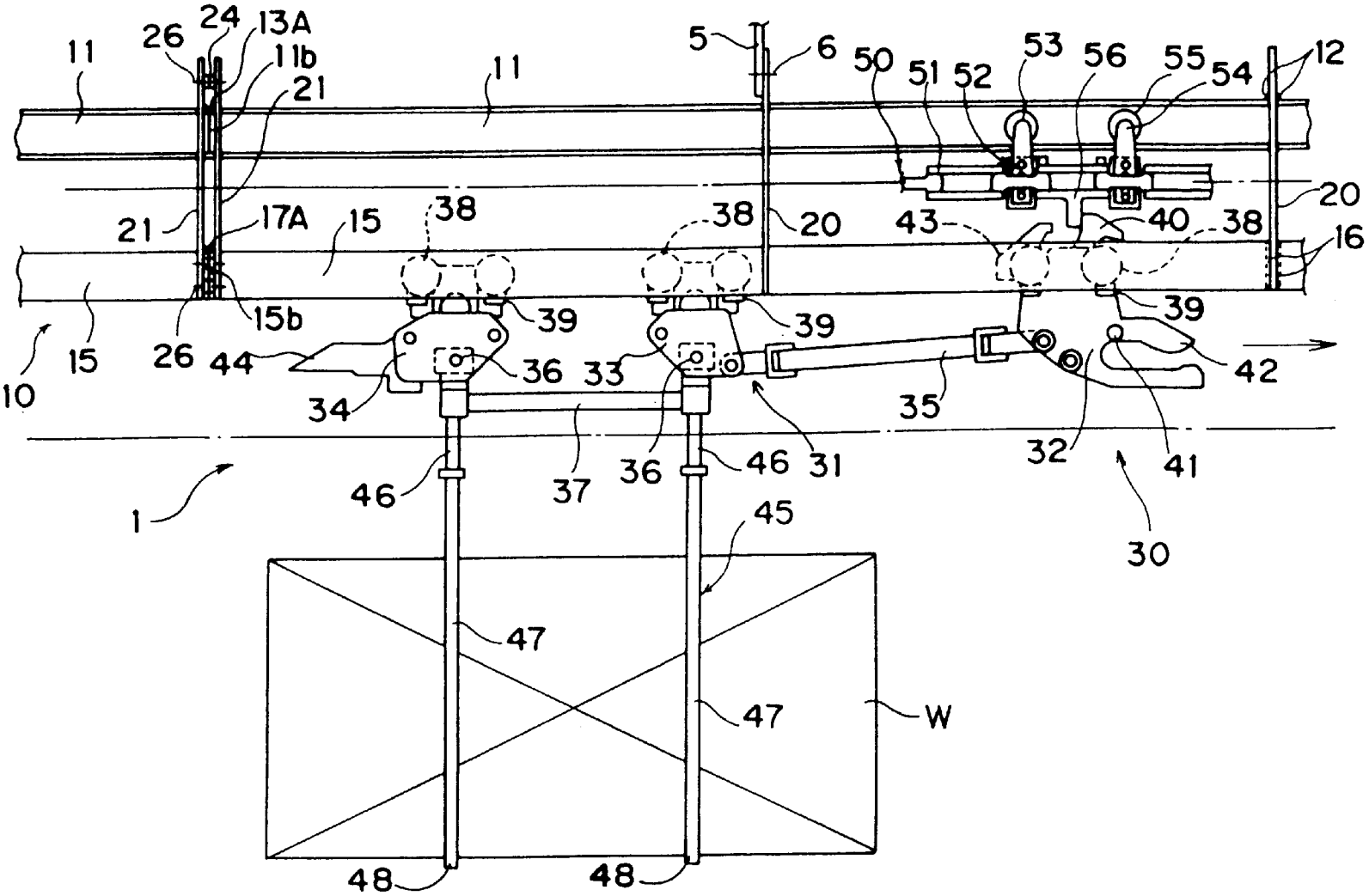
FIG. 4 is a side view illustrating the rail system for carrier equipment shown in FIG. 1.

Now, description will be made of embodiments of the present invention wherein the rail system is adopted for a suspended carrier equipment for carrying articles along a definite route laid along a ceiling.

First through fifth embodiments relates to a structure for connecting rail ends, whereas sixth through eighth embodiments relate to a structure for coupling upper and lower rails.

The first embodiment will be described with reference to FIGS. 1 through 4.

The suspended carrier equipment comprises a rail unit 10, a carrier unit 30 which is supported and guided by the rail unit 10, and others.

The rail unit 10 comprises a first rail 11 which is composed of an I-shaped member and disposed at a higher location, a pair of second right and left rails 15 which are composed of C-shaped members and disposed at lower locations with their openings opposed to each other, gate-shaped intermediate yoke members 20 which are disposed at predetermined locations in a longitudinal direction of the rails for binding the rails 11 and 15, end yoke members 21, and others.

The yoke members 20 and 21 are gate-shaped planar plates having a pair of right and left (a singularity or a plurality of) slots 22 for coupling implements which are formed in the middle of an upper plate portion thereof, and a pair of upper and lower (a singularity or a plurality of) slots 23 for lower coupling implements which are formed in lower locations of both side plate portions. A lower edge of the middle of the upper plate portion of the intermediate yoke member 20 is welded, on both side surfaces thereof 12, to a top surface 11*a* of the first rail 11, and an inside edge of the lower locations of both the side plate portions are welded, on both side surfaces thereof 16, to an outer surfaces 15*a* of the second rails 15, thereby binding the rails 11 and 15 with one another.

The end yoke member 21 is welded to the first rail 11 and the second rails 15 similarly to the intermediate yoke member 20 described above. At this welding stage, the end yoke member 21 has been fixed to end surfaces 11*b* and 15*b* of the rails 11 and 15, at locations where welding margins L are left within the end surfaces 11*b* and 15*b*, by double welding 13A, 13B, 17A and 17B (or single welding 13A and 17A) utilizing the welding margin L. Further, cylindrical washers (an example of intermediate members) 24 which are thick enough to fill the welding margin L described above have fixed by welding (tack welding or regular welding) 25 to an outside end surface of the end yoke member 21 in a condition where holes of the washers are communicated with the slots 22 and 23 for coupling implements.

In a condition where end surfaces 11*b* and 15*b* of the rails 11 and 15 are opposed (or brought into contact) in the longitudinal direction of the rails, end yoke members 21 are coupled by way of coupling implements 26 passing through the slots 22, 22, 23, 23. The coupling implements 26 consists, for example, of bolts 27, nuts 28 and washers 29, and nuts 28 are screwed and tightened after the bolts 27 pass through the slots 22, 23 for coupling implements, the washers 24, 24 and the slots 22, 23 for coupling implements.

The rail unit 10 is comprised of the members 11 through 29 described above. The intermediate yoke member 20 is coupled, for example, by way of a bracket 5 suspended from a ceiling structure (not shown) and coupling implements 6 consisting of nuts and bolts passing through the slots for coupling implement.

In the rail unit 10 so comprised as described above, the second rail 15 supports and guides a moving body (described later), and the first rail 11 supports and guides the driving body (described later) using a chain for imparting a moving force to the moving body.

A trolley system 31, an example of the moving body, is comprised of a front trolley 32, a free trolley 33, a rear trolley 34, a coupling lever 35 which couples the front trolley 32 with the free trolley 33, a coupling frame 37 for coupling trunnion pins 36 studded on the free trolley 33, the rear trolley 34 and so on. Disposed on each of the trolleys 32, 33 and 34 are guide wheels 38 which are supported and guided by the second rails 15 while fitted therebetween, and swing preventive wheels 39 which are supported and guided by second rails 15 while located between the lower plate portions thereof.

A motion receiver 40 is disposed on the front trolley 32 so as to be freely movable vertically relative to a body for transmitting motion (described later) from the driving body, an operating lever 42 which can vertically swing around a lateral shaft 41 extends from the front trolley, and a rear end of operating lever 42 is coupled with a lower end of the motion receiver 40 by way of a pin. Accordingly, the operating lever 42 and the motion receiver 40 are interlocked so that the motion receiver 40 goes down when a front end of the operating lever 42 swings upward.

Disposed at a location behind the motion receiver 40 on the top of the front trolley 32 is an overrun preventive body (hold dog) 43 which prevents the motion receiver 40 from running over frontward while the motion receiver 40 is engaged with the motion transmitting body. This overrun preventive body 43 is so structured as to freely swing forward and backward around a pin and its top end is urged by a weight so as to be located within a moving path of the motion transmitting body. In addition, a cam tail 44 which vertically swings the operation lever 42 extends rearward from the rear troller 34.

A support unit 45 for carried articles is attached to the trolley system 31. The support unit 45 comprises C necks 46 attached to lower ends of both the trunnion pins 36, arms 47 which are attached to lower ends of the C necks 46 and extend downward, and support members 48 disposed horizontally at lower ends of the arms 47. A reference symbol W represents a carried article.

A driving body 50 which is supported and guided by the first rail 11 for imparting a moving force to the trolley system 31 comprises a link chain 51, a trolley member 52 disposed at a predetermined location in a longitudinal direction of the link chain 51, a motion transmitting body 56 which hangs from the link chain in the vicinity of the trolley member 52 and freely engageable with the motion receiver 40, and others.

The trolley member 52 comprises a pair of right and left troller bodies 53 disposed on a center link of the link chain 51, rollers 55 which are disposed on ends (tops) of the trolley bodies 53 freely rotatably around lateral shafts 54, and so on. The rollers 55 are supported and guided by a top surface of the lower plate portion of the upper rail 11. The link chain 51 is interlocked with a driving member (such as a motor not shown).

Description will be made of functions of the first embodiment explained above.

The intermediate yoke members 20 and the end yoke members 21 which bind the first rail 11 and the second rails 15 are formed as gate-shaped planar plates having the same form and slots for coupling implements 22 and 23 formed at predetermined locations.

Before assembling the rail unit 10, the first rail 11 and the second rails 15 are bound by way of the intermediate yoke members 20 and the end yoke members 21. More specifically, the rails 11 and 15 are bound by double welding 12 the lower edge in the middle of the upper plate portion of each intermediate yoke member 20 to the top surface 11*a* of the first rail 11 and double welding 16 the inside edges at the lower portions of both the side plate portions to the outside surfaces 15*a* of the second rails 15.

The rails 11 and 15 are coupled by fixing the end yoke members 21 to the rail ends at the locations where the welding margins L are left within the end surfaces 11*b* and 15*b* of the rails 11 and 15, with double weldings 13A and 13B, and by fixing the lower inside edges of both the side plate portions to outside surfaces 15*a* of the second rails 15 with double weldings 17A and 17B, both the weldings 13A and 13B, and 17A and 17B utilizing the welding margins L.

A divided rail system thus comprised is coupled with the brackets 5 suspended from a ceiling structure by way of coupling implements 6 passing through the slots 22 for upper coupling implement formed in the intermediate yoke members 20, thereby being suspended from the ceiling structure. To the rail system thus suspended, other divided rail systems are connected and suspended. The washers 24 are fixed by welding (for example, tack welding) 25 at the predetermined locations on the outside surfaces of the end yoke members 21 immediately before the rails are connected or while the rails 11 and 15 are bound by the double weldings 13A, 13B, 17A and 17B.

For connecting the rails utilizing the end yoke members 21, the end yoke members 21 are connected to each other by way of the coupling implements 26 passing through the slots 22, 22, 23 and 23 for coupling implements in a condition where the end surfaces 11*b* and 15*b* are opposed to each other (in contact with each other). This connection can be performed by passing the bolts 27 through the slots 22, 23 for coupling implements, the washers 24, 24 and slots 22, 23 for coupling implements, fitting the washers 29 over the protruding ends of the bolts, and screwing and tightening the nuts 28.

Since the cylindrical washers 24 which are thick enough to fill the welding margins L fixed to the outside end surfaces of the end yoke members 21 as described above, tightening forces of the coupling implements 26 act between the washers 24 brought into contact or do not act between the end surfaces 11*b*, 15*b* and 11*b*, 15*b* of the rails 11 and 15 which are brought into contact or between the end surfaces of the end yoke members 21 which are liable to be deformed, whereby the rails can be easily, speedily and precisely by way of the end yoke members 21 and the coupling implements 26.

At an operation time after completing the assembly of the rail system 10 and incorporation of the carrier equipment 30, a motion transmitting body 56 is engaged with the motion receiving body 40, whereby the trolley system 31 moves along the definite route while receiving moving force from a riving body 50. At this stage, the front end of the operating lever 42 swings downward. Should the trolley system 31 run over during the movement, the overrun preventive body 43 is brought into contact with the rear surface of the motion transmitting body 56, thereby preventing the trolley system 31 from running over.

At the operation time described above, the guide wheels 38 of the trolley system 31 are sandwiched, supported and guided by the second rails 15, and the swing preventive wheels 39 are located and guided between the lower plate portions of the second rails 15, whereby the carrier equipment moved stably along the definite route without being swung remarkably. Further, the driving body 50 is moved smooth while the rollers 55 are supported and guided by the first rail 11.

Figure 5:
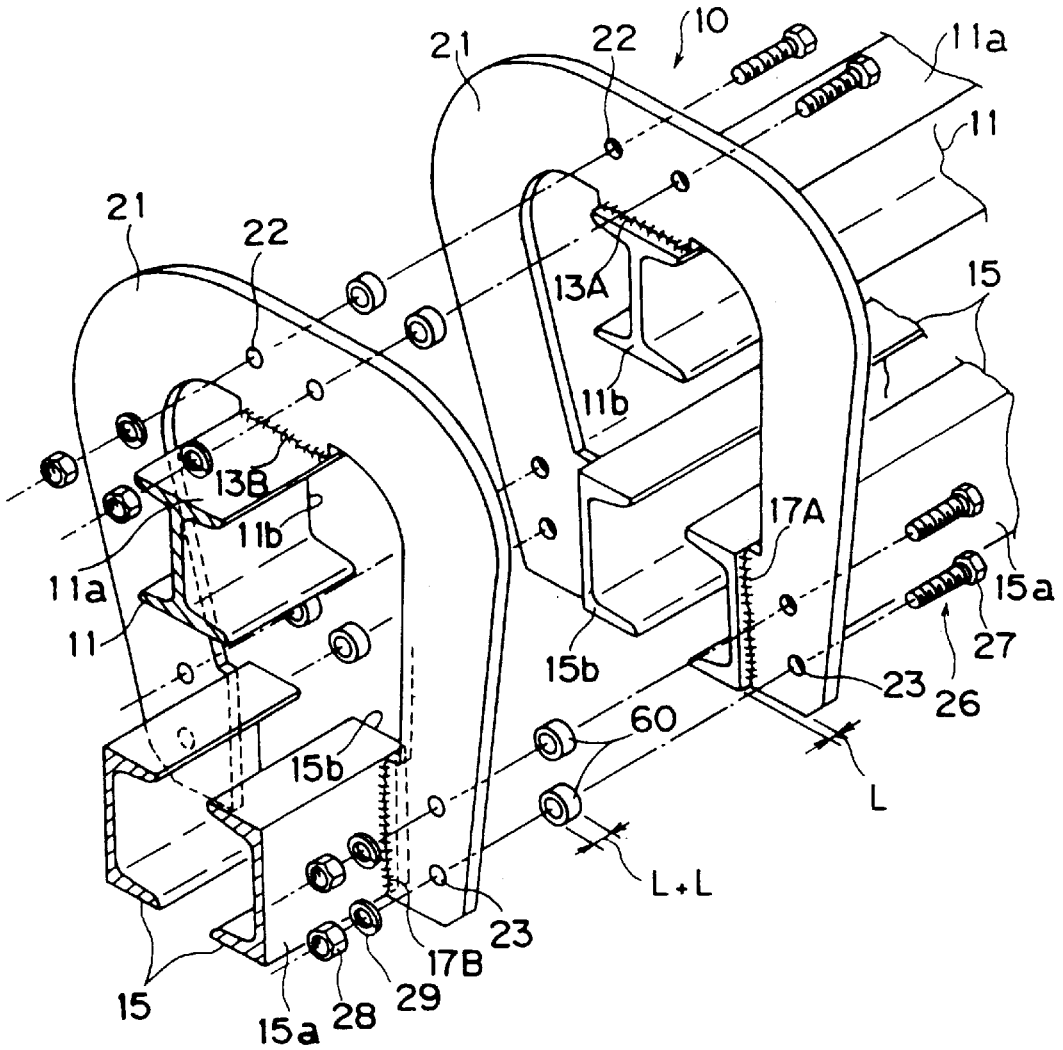
FIG. 5 is a perspective view illustrating a second embodiment of the rail system for carrier equipment according to the present invention in a condition where main members are not coupled.
Figure 6:
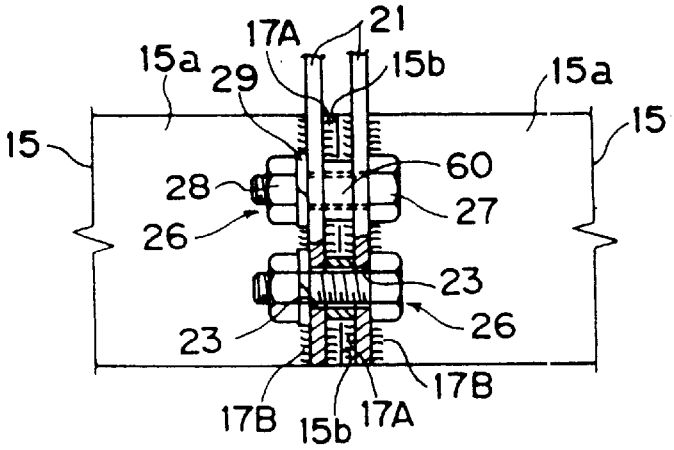
FIG. 6 is a partially cut side view illustrating the rail system for carrier equipment shown in FIG. 5 in a condition where the main members are coupled.

Now, a second embodiment of the present invention will be described with reference to FIGS. 5 and 6.

In this embodiment, intermediate members for filling welding margins L are composed of cylindrical spacers 60 which are disposed between end yoke members 21 and 21, and thick enough to fill the welding margins on both sides (L+L).

For connecting end yoke members 21 and 21 by coupling implements 26 in the second embodiment, the spacers 60 are interposed in free conditions between the end yoke members 21 and 21, and bolts 27 are passed through slots 22, 23 for coupling implements, spacers 60 and slots for coupling implement 22 and 23. Since spacers 60 which are thick enough to fill both the welding margins L (L+L) on outside end surfaces of the end yoke members 21 at a stage to screw and tighten nuts 28 over protruding ends of the bolts 27, tightening forces of the coupling implements 26 act locally on the end yoke members 21 by way of the spacers 60.

Figure 7:
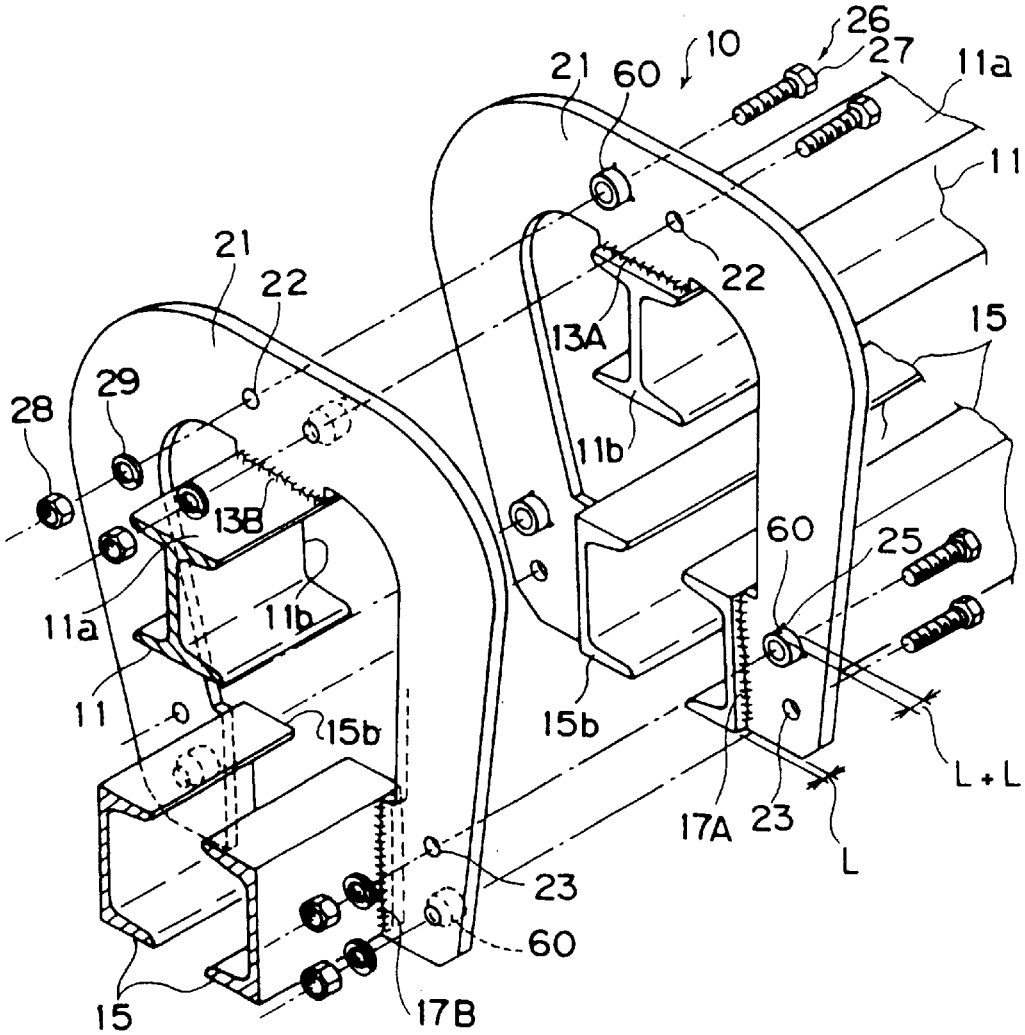
FIG. 7 is a perspective view illustrating a third embodiment of the rail system for carrier equipment according to the present invention in a condition where main members are not coupled.
Figure 8:
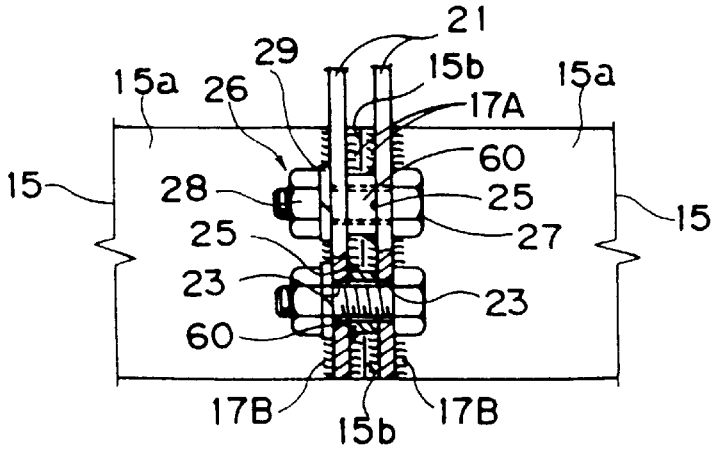
FIG. 8 is a partially cut side view illustrating the rail system for carrier equipment shown in FIG. 7 in a condition where the main members are coupled.

Now, a third embodiment of the present invention will be described with reference to FIGS. 7 and 8.

In the third embodiment, a plurality of slots 22, 22, 23 and 23 for coupling implement are formed in end yoke members 21 and 21, and a plurality of intermediate members are composed of spacers 60 which are thick enough to fill welding margin L on both sides (L+L) and welded (tack welded or regularly welded) distributedly on the end yoke members opposed to each other. The spacers 60 are distributed for pairs of slots 22, 22 and 23, 23 for coupling implements.

For connecting the end yoke members 21, 21 with coupling implements 26 in the third embodiment, the spacers 60 are disposed between the end yoke members 21 and 21 in conditions where the spacers are tack welded to either of the end yoke member 21, and bolts 27 are passed through the slots 22, 23 for coupling implements, the spacers 60 and the slots 22, 23 for coupling implements. Since the spacers 60 having thickness (L+L) enough for filling both the welding margins L on an outside end surface of the end yoke member 21 at a stage to screw and tighten nuts 28 over protruding ends of the bolts 27, tightening forces of the coupling implements act locally on the end yoke member 21 by way of the spacers 60.

Figure 9:
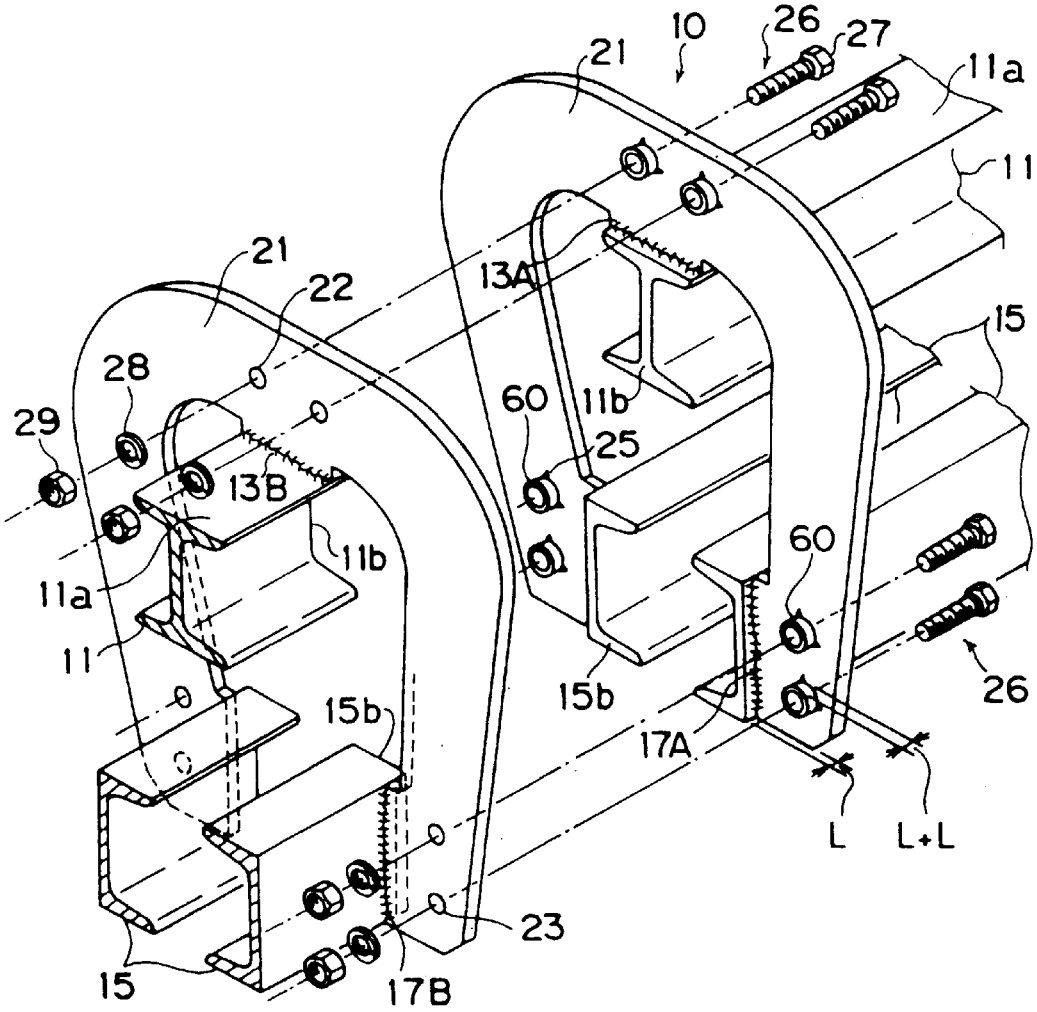
FIG. 9 is a perspective view illustrating a fourth embodiment of the rail system for carrier equipment according to the present invention in a condition where main members are not coupled.
Figure 10:
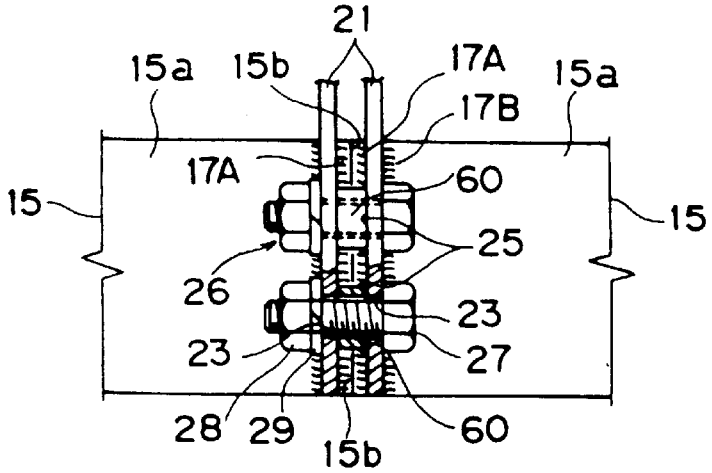
FIG. 10 is a partially cut side view illustrating the rail system for carrier equipment shown in FIG. 9 in a condition where the main members are coupled.

Then, a fourth embodiment of the present invention will be described with reference to FIGS. 9 and 10.

In the fourth embodiment, a plurality of a plurality of slots 22, 22, 23 and 23 for coupling implements are formed in end yoke members 21, 21, and a plurality of intermediate members are composed of spacers 60 which have thickness enough for filling welding margins L on both sides and are welded (tack welding or regular welding) to either of the end yoke members opposed to each other.

For connecting the end yoke members 21, 21 in the fourth embodiment, the spacers 60 are interposed between the end yoke members 21 and 21 in a condition where the spacers 60 are tack welded collectively to either of the end yoke members 21, and bolts 27 are passed through the slots 22, 23 for coupling implements, the spacers 60, and slots 22, 23 for coupling implement. Since the spacers 60 having the thickness enough for filling the welding margins L on both the sides are disposed on an outside end surface of the end yoke member 21 at a stage to screw and tighten nuts 28 over protruding ends of the bolts 27, tightening force of coupling implements 26 act locally on the end yoke member 21 by way of the spacers 60.

Figure 11:
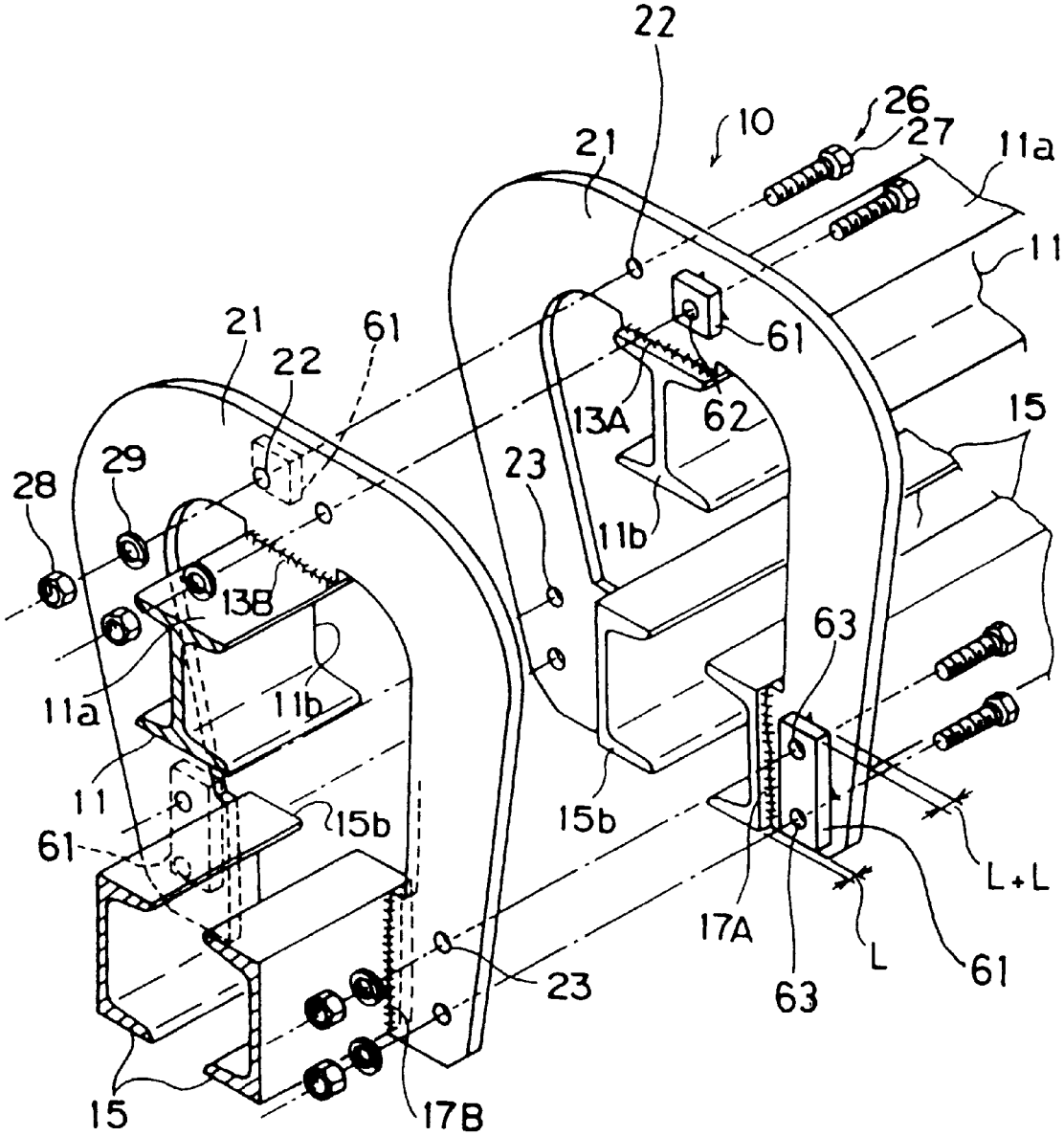
FIG. 11 is a perspective view illustrating a fifth embodiment of the rail system for carrier equipment according to the present invention where main members are not coupled.

A fifth embodiment of the present invention will be described below with reference to FIG. 11.

In this embodiment, a plurality of slots 22, 22, 23 and 23 for coupling implements are formed in end yoke members 21, 21, and a plurality of intermediate members are composed of plate-like spacers 61 which have thickness (L+L) enough for filling welding margins L on both sides, and are distributed for the slots 22, 22, 23 and 23 located on one side of a center line between the end yoke members 21, 21, and welded (tack welding or regularly welded) around the slots. Formed in the plate-like spacers 61 are communicating holes 62, 62, 63 and 63 at locations corresponding to the slots 22, 22, 23 and 23 for coupling implement.

For connecting the end yoke members with coupling implements 26 in the fifth embodiment, front and rear ends of rails are ignorable since the plate-like spacers 61 are disposed between the end yoke members 21, 21 in the condition where they are distributed and tack welded to one side of the center line between the end yoke members 21, 21. At this connection stage, bolts 27 are passed through the slots 22, 23 for coupling implement, the communicating holes 62, 62, 63, 63 formed in the plate-like spacers 61, and the slots 22, 23 for coupling implement. Since the plate-like spacers 61 having the thickness (L+L) sufficient for filling both the welding margins L are disposed on an outside end surface of the end yoke member 21 at a stage to screw and tighten nuts 28 over protruding ends of the bolts 27, tightening forces of the coupling implements act locally on the end yoke member 21 by way of the plate-like spacers 61.

Figure 12:
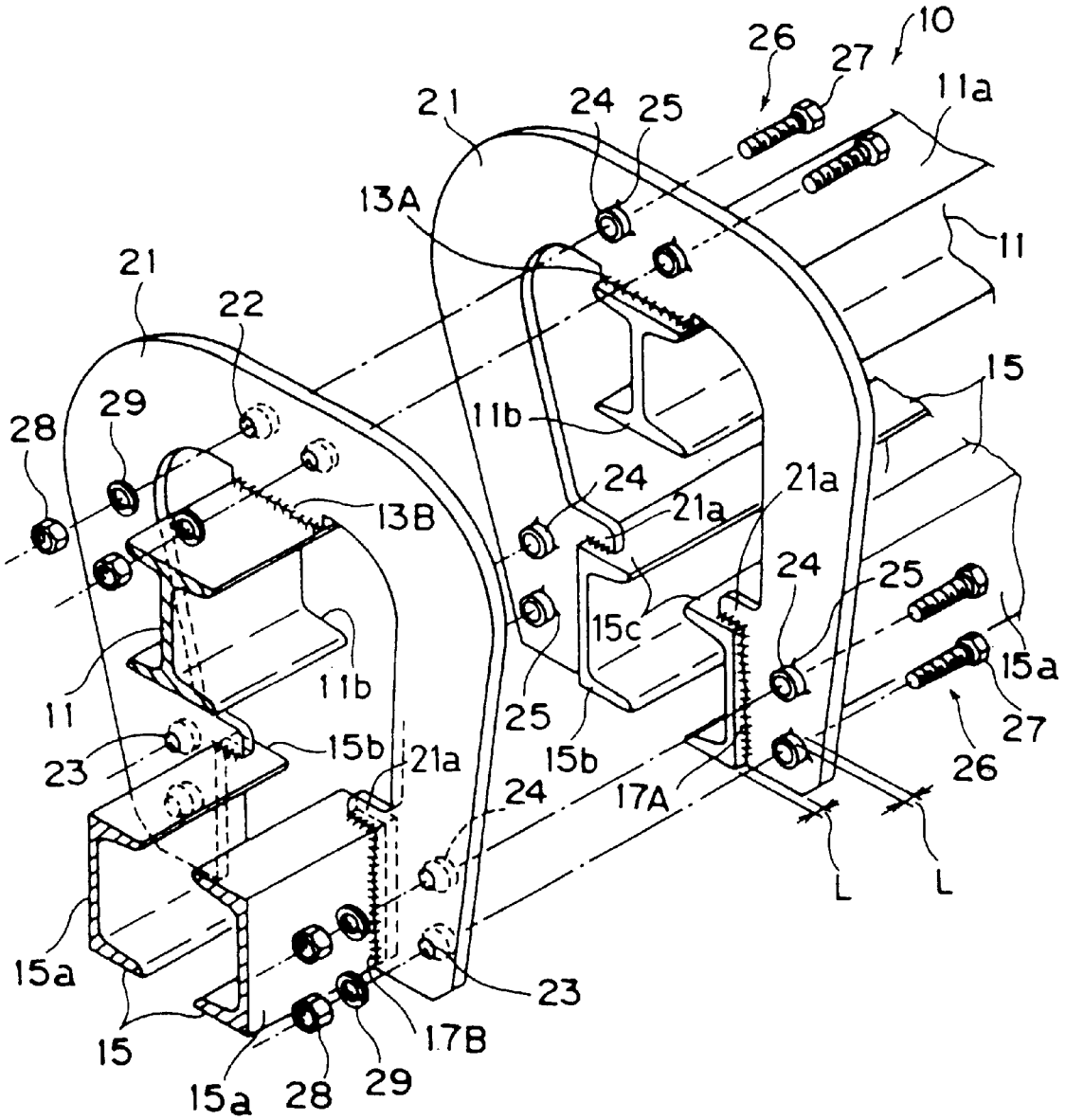
FIG. 12 is a perspective view illustrating a sixth embodiment of the rail system for carrier equipment according to the present invention in a condition where main members are not coupled.
Figure 13:
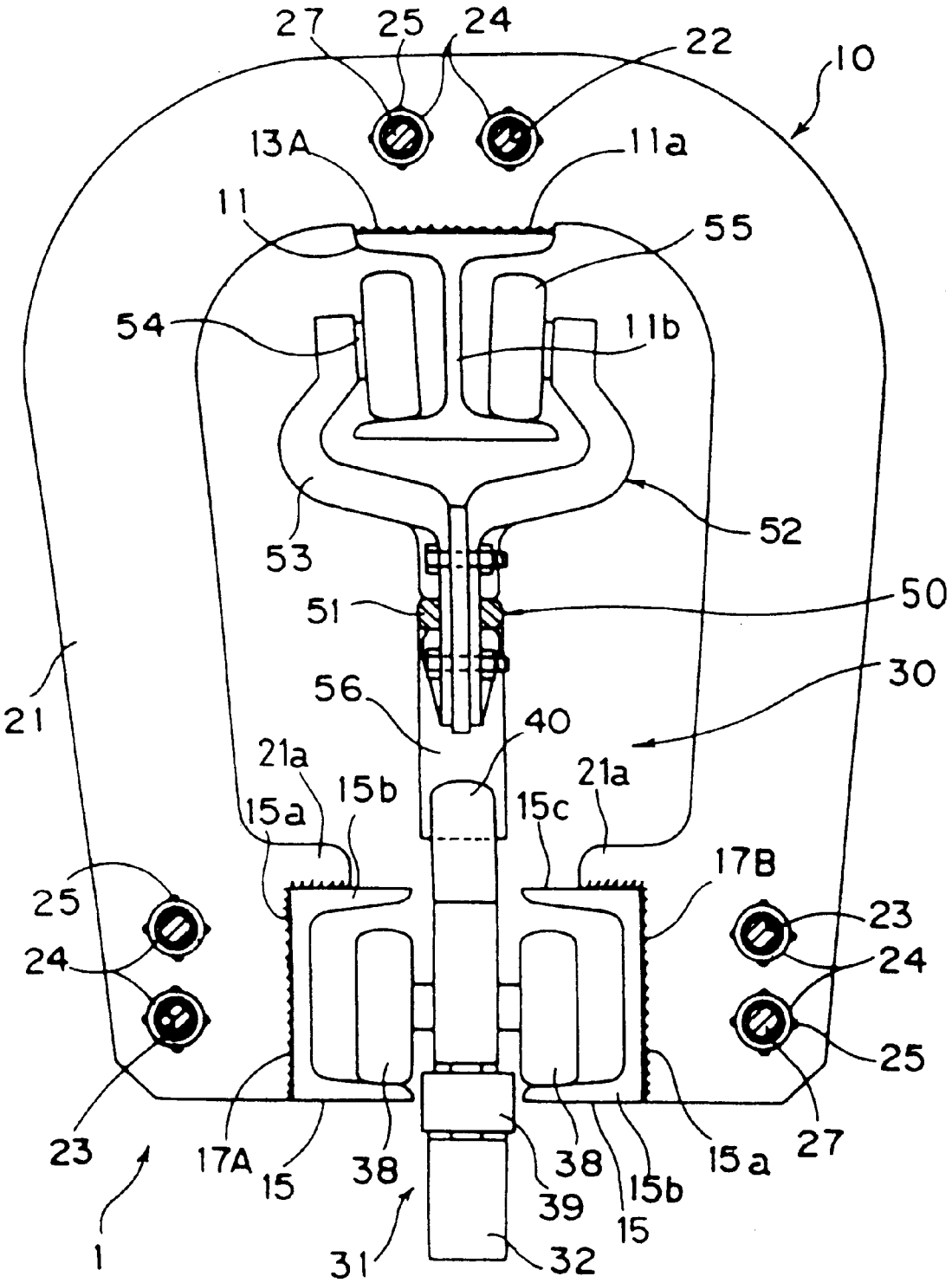
FIG. 13 is a vertical sectional front view illustrating the rail system for carrier equipment shown in FIG. 12 in a condition where the main members are coupled.

Now, description will be made of a sixth embodiment of the present invention with reference to FIGS. 12 and 13.

In this embodiment, end yoke members 21, 21 have portions 21*a*, 21*a* which are formed integrally therewith, inwardly protruded from lower portions of the end yoke members 21, 21 to be in contact with top surfaces 15*c* of second rails 15 and coupled with the second rails 15 by weldings 17A, 17B. Intermediate yoke members 20 have the similar shape and coupled with the second rails 15.

The sixth embodiment having a configuration wherein the protruding portions 21*a*, 21*a* are added enhances strength of the intermediate and end yoke members 20, 21, 21 for binding the second rails 15 since the second rails 15 are in contact with the intermediate and end yoke members 20, 21, 21 in two directions and for a longer distance or weld lines.

Though a suspended carrier equipment 1 is described as the carrier equipment in the first through sixth embodiments described above, the suspended carrier equipment 1 may be of a floor type carrier equipment which moves a truck.

Though the rail system 10 is of a type wherein a first rail 11 composed of an I-shaped member is combined with the second rails 15 composed of C-shaped members in the first through fifth embodiments described above, various combinations of rails may be adopted, for example, the first rail may consist of a pair of right and left rails composed of C-shaped members having openings opposed to each other.

Though the washer 24 and the spacer 60 are used for each of the slot 22 and 23 for coupling implement in the first through sixth embodiments described above, a washer or a spacer may be used commonly for a pair of right and left slots 22 and 23 for coupling implement.

Though the coupling implement 26 is of a type consisting of a bolt and nut in the first through sixth embodiments described above, the coupling implement may of a rivet type or a bolt-self-locking nut type.

Though the driving body 50 using a chain is supported and guided by the upper rail 11 in the first through sixth embodiment described above, a moving force may be imparted to the trolley system 31 from an auto motive body supported and guided by the upper rail 11.

Figure 14:
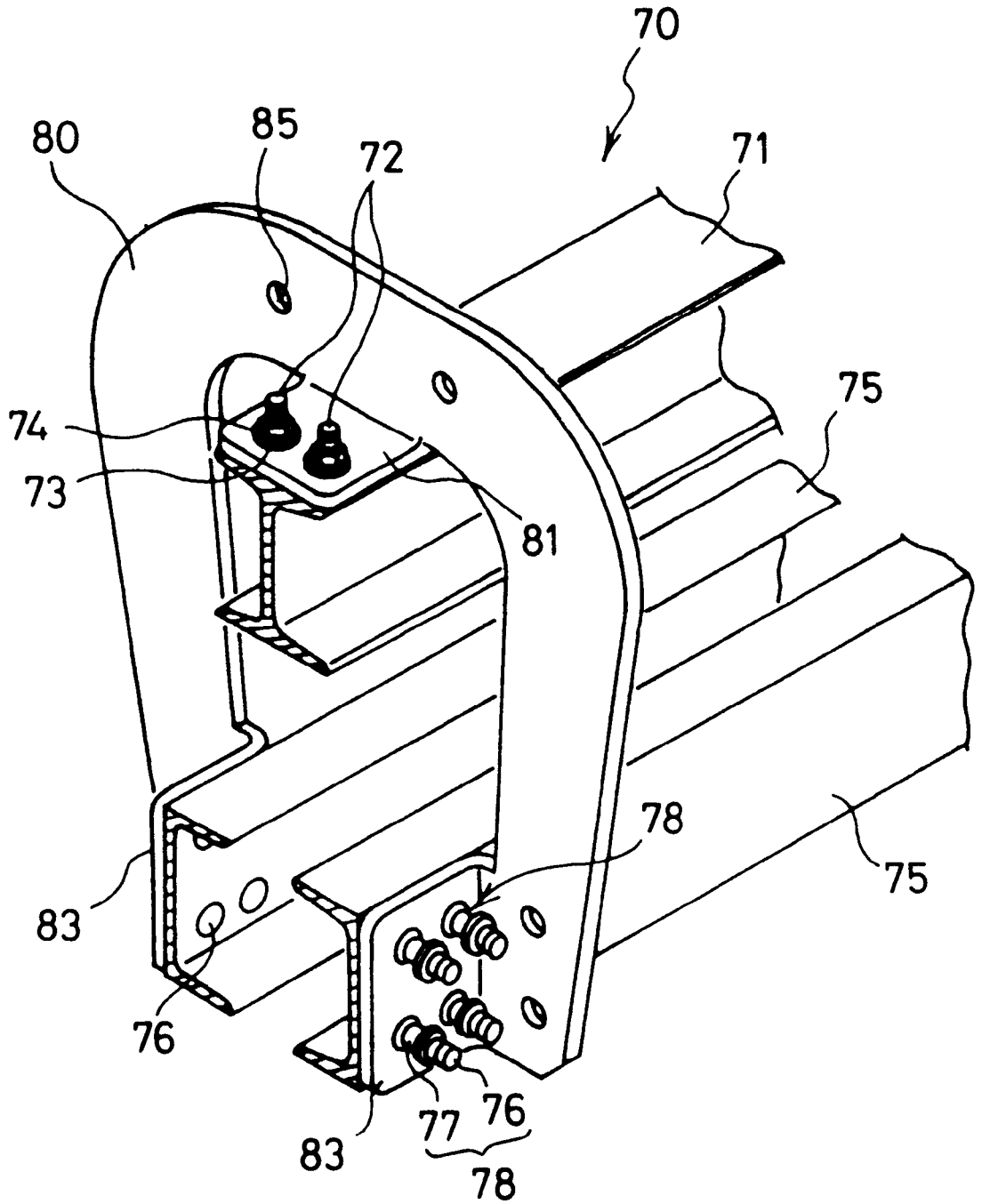
FIG. 14 is a perspective view illustrating main members of a seventh embodiment of the rail system for carrier equipment according to the present invention.
Figure 15:
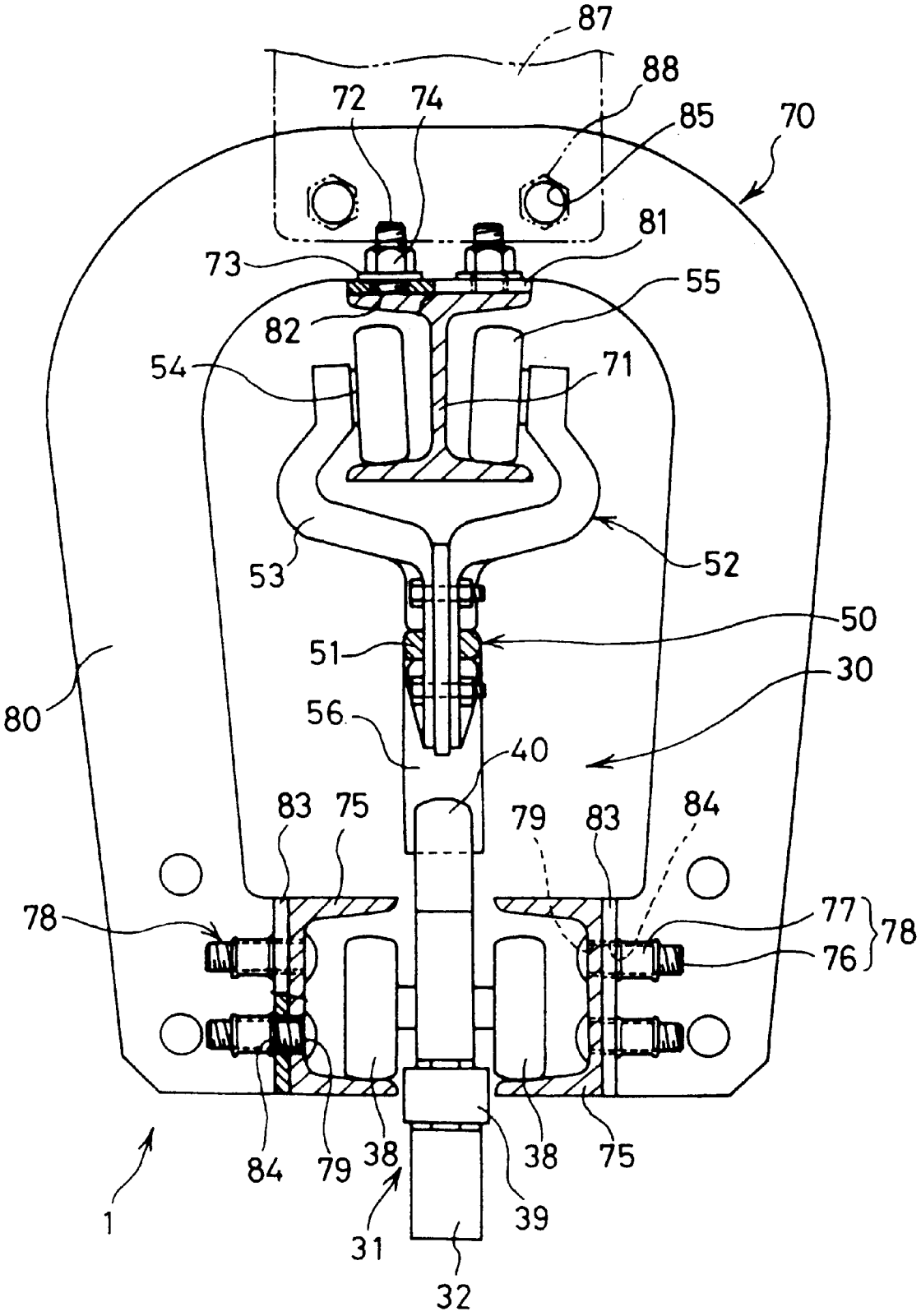
FIG. 15 is a partially cut front view illustrating the main members of the rail system for carrier equipment shown in FIG. 14.
Figure 16:
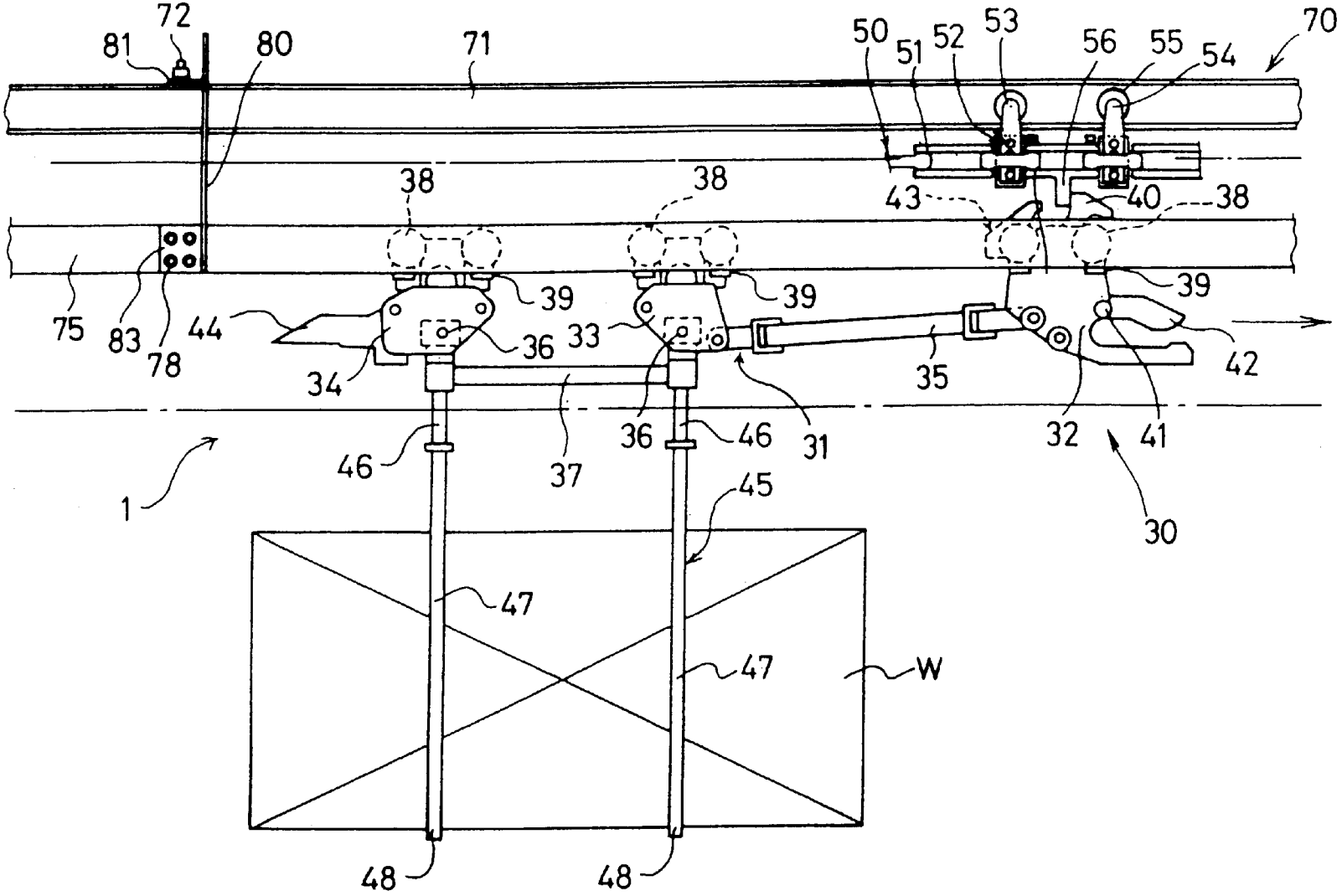
FIG. 16 is a side view illustrating the main members of the rail system for carrier equipment shown in FIG. 14.

A seventh embodiment of the present invention will be described below with reference to FIGS. 14 through 16.

A suspended carrier equipment 1 comprises a rail system 70, a career equipment 30 which is supported and guided by the rail system, and so on.

The rail system 70 comprises an upper rail 71 composed of an I-shaped member, a pair of lower rails 75 composed of C-shaped members having openings opposed to each other, gate-shaped yoke members 80 disposed at predetermined locations in a longitudinal direction for binding the rails 71 and 75, and so on.

The yoke member 80 is a gate-shaped plate having an upper coupling piece 81 which is formed integrally therewith and bent perpendicularly from a lower edge in the middle of an upper plate portion in a longitudinal direction of the rails, and a pair (a singularity or a plurality) of right and left bolt holes 82 are formed in the upper coupling piece 81. Further, the yoke member 80 has lower coupling pieces 83 which are formed integrally therewith and bent perpendicularly from lower inside edges of side plate portions in the longitudinal direction of the rails and four (single or plural) lower bolt holes 84 are formed in these lower coupling pieces 83.

The upper coupling piece 81 is configured to be connected to the upper rail 71. Speaking concretely, a pair of right and left (single or plural) stud bolts 72 are studded by pressure welding at predetermined locations on a top surface of an upper plate portion of the upper rail 71. The upper rail 71 is connected to the yoke member by way of the stud bolts 72 and the upper coupling piece 81 by passing the stud bolts 72 through the upper bolt holes 82, fitting washers 73 over protruding portions of the stud bolts 72 and screwing nuts 74.

The lower connecting pieces 83 are configured to be connected to the lower rails 75 by way of fixing implements passing through the lower rails 75, i.e., fixing implements 78 consisting of round head bolts 76 and self-locking nuts 77. For these fixing implements, four coupling (single or plural) slots 79 are formed at predetermined locations on side plate portions of the lower rails 75. The right and left lower rails 75 are connected to the yoke member 80 by way of the fixing implements 78 and the lower coupling pieces 83 by communicating the coupling holes 79 with the lower bolt holes 84, passing the round head bolts 76 from the side of the coupling holes 79, and screwing and caulking the self-locking nuts 77 over protruding portions of the round head bolts 76.

Coupling holes 85 are formed in the upper plate portion of the yoke member 80. The rail system 70 comprises the members 71 through 85 described above. The yoke member 80 is connected to a bracket 87 suspended from a ceiling structure (not shown) by way of coupling implements 88 consisting of bolts and nuts.

A carrier equipment which is to be supported and guided by the rail system 70 described above has a configuration similar to that in the first embodiment described above. Speaking roughly with details omitted, a trolley system 31 is supported and guided by the lower rails 75, and a driving body 50 using a chain is supported and guided by the upper rail 71.

Description will be made below of functions of the seventh embodiment explained above.

Before assembly of the rail system 70, the stud bolts 72 are studded by pressure welding at the predetermined locations on the upper plate portion of the upper rail 71. Further, the coupling holes 79 are formed at the predetermined locations of the side plate portions of the lower rails 75. The yoke member 80 comprises the gate-shaped plate having the upper coupling piece 81 and the lower coupling pieces 83 which are formed integrally by bending, and the bolt holes 82 and 84 are formed at the predetermined locations of these coupling pieces 81 and 83.

For assembling the rail system 70, the upper rail 71 is connected to the yoke member 80 by way of the upper coupling piece 81 and the like by passing the stud bolts 72 through the upper bolt holes 82 from underside, fitting the washers 73 over protruding portions of the stud bolts 72 and screwing nuts 74. The right and left lower rails 75 are connected to the yoke member 80 by way of the fixing implements 78 and the lower coupling pieces 83 by communicating the coupling holes 79 with the lower bolt holes 84, passing the round head bolts 76 from the side of the coupling holes 79, and screwing and caulking the self-locking nuts 77 over protruding portions of the round head bolts 76.

The rails 71 and 75 can be coupled by way of the yoke member 80 easily and speedily by screwing the nuts 74, and screwing and caulking the self-locking nuts 77. Moreover, erection of the stud bolts 72 on the upper rail 71, formation of the coupling holes 79 in the lower rails 75, bending formation of the coupling pieces 81 and 83 as well as formation of the bolt holes 82 and 84 in the yoke member 80, etc. can be performed with high precisions while handling the members independently on the ground, whereby the rail system can be assembled with high precision.

The yoke member 80 is coupled with the bracket 87 suspended from the ceiling structure by way of the coupling implement 88 consisting of the bolts and nuts before or after assembly into the rail system 70, thereby being constructed on the ceiling.

At the operation time after completing the predetermined assembly of the rail system 70 and the incorporation of the carrier equipment 30, the guide wheels of the trolley system 31 are supported and guided by the lower rails 75 while being fitted therebetween, and the swing preventive wheels 39 are guided while being located between the end surfaces of the lower plate portions of the lower rails 75, whereby the rail system 70 is capable of preventing the guide wheels 38 from being brought into contact with exposed round heads of the round head bolts 76 due to swing and allowing the carrier equipment 30 to move stably along the definite route.

Further, the driving body 50 is moved while its rollers 55 are being supported and guided by the upper rail 71 and, should the driving body 50 vibrate (or swing) within a restricted range in the vertical direction during its movement, the rollers 55 are moved smooth without being brought into contact with the other members such as the coupling means since the stud bolts 72 which are not exposed inside are used as the coupling means for the upper rail 71.

Figure 17:
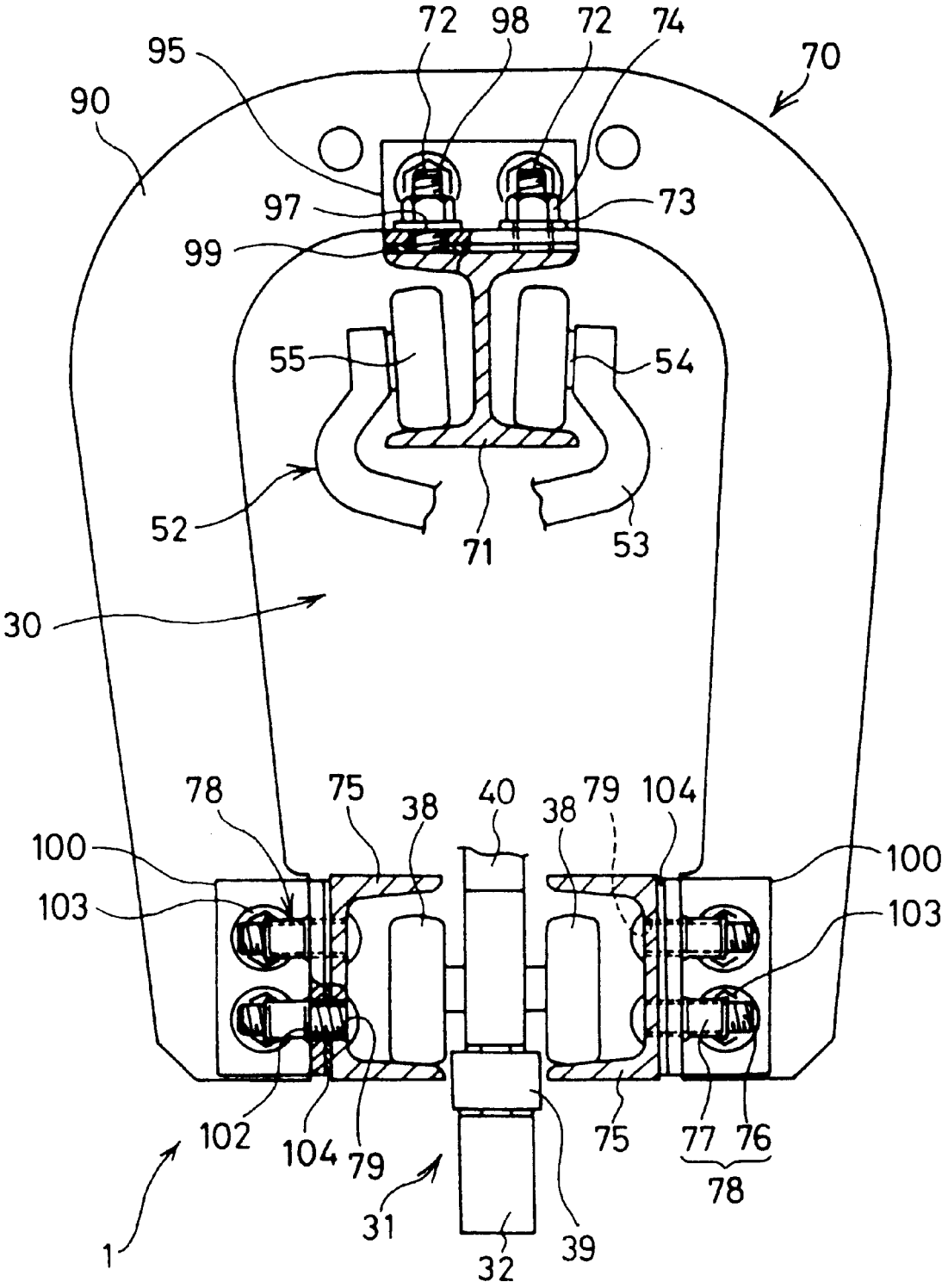
FIG. 17 is a partially cut front view illustrating main members of an eighth embodiment of the rail system for carrier equipment according to the present invention.
Figure 18:
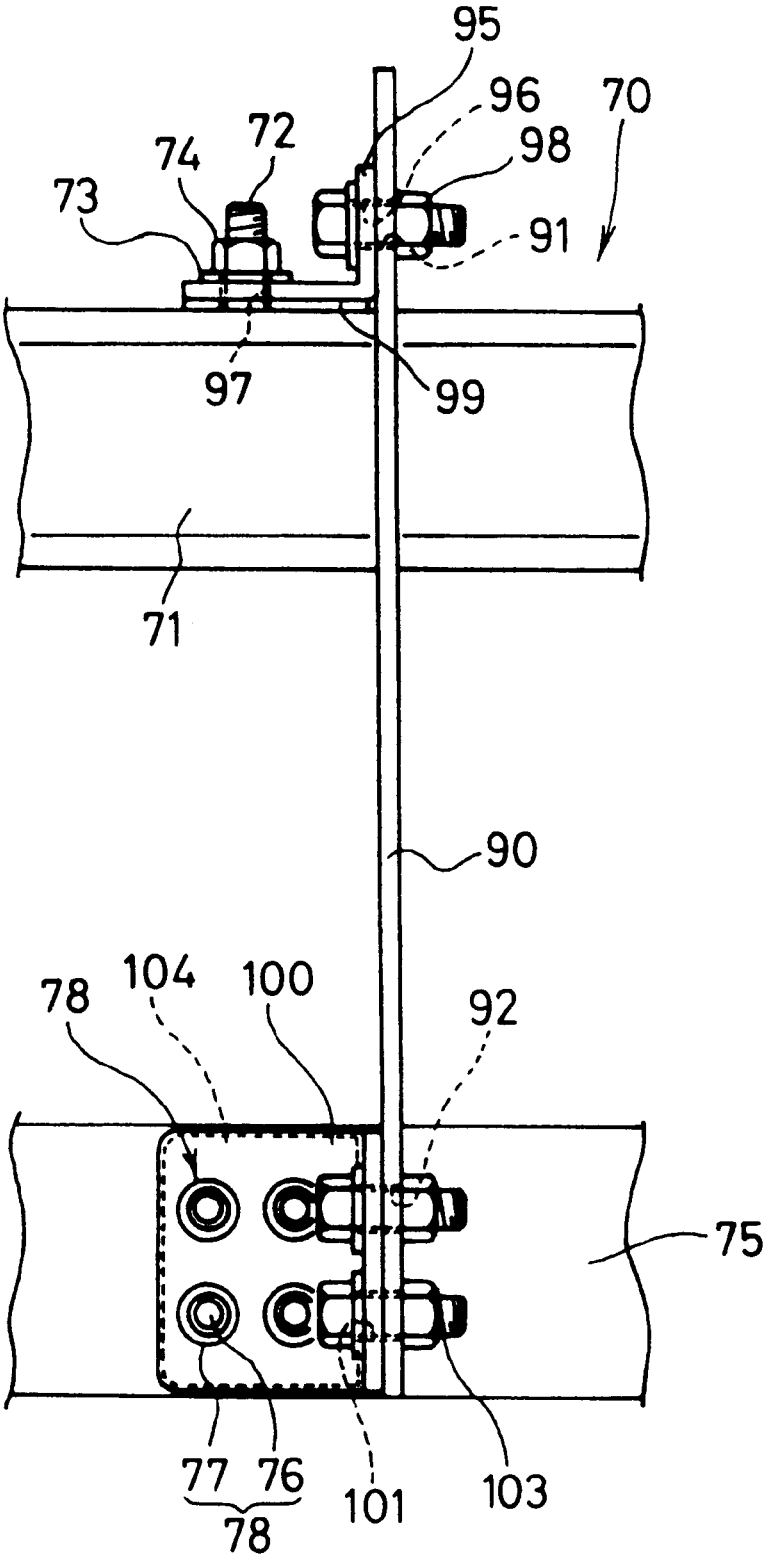
FIG. 18 is a side view illustrating the main members of the rail system for carrier equipment shown in FIG. 17.

Now, an eighth embodiment will be described with reference to FIGS. 17 and 18.

A yoke member 90 is a gate-shaped plate, an upper coupling body 95 is fixed to a middle location of an upper plate portion of the yoke member 90 by way of fixing implements 98 and lower coupling bodies 100 are fixed to lower locations of both side plate portions of the yoke member 90 by way of fixing implements 103. In other words, a pair of right and left (single or plural) slots 91 for upper coupling implements are formed in the middle location of the upper plate portion of the yoke member 90, and a pair of upper and lower (single or plural) slots 92 for lower coupling implements are formed in each of the lower locations of both the side plate portions.

The coupling bodies 95 and 100 are composed of short L-shaped members, and a pair of right and left (single or plural) slots 96 for upper coupling implements and a pair of upper bolt holes 97 are formed along sides of the upper coupling body 95. Further, a pair of upper and lower (single or plural) slots 101 for lower coupling implements are formed along a side of the lower coupling body 100, and four (single or plural) lower bolt holes 102 are formed along the other sides.

A side surface of the L-shaped upper coupling body 95 is fixed to the yoke member 90 by communicating the slots 96 for upper coupling implement with the slots 91 for upper coupling implement formed in the yoke member 90, and activating the fixing implements 98 consisting of bolts and nuts through both the slots 96 and 91. Planar surfaces of the L-shaped lower coupling bodies 100 are fixed to the yoke member by communicating the slots 101 for lower coupling implement with the slots 92 for lower coupling implement formed in the yoke member 90, and activating the fixing implements 103 consisting of bolts and nuts through the slots 101 and 92.

Further, the upper rail 71 is coupled with the yoke member 90 by way of the stud bolts 72 and the upper coupling body 95 by passing the stud bolts 72 through the upper bolt holes 97, fitting the washers 73 over protruding portions of the stud bolts 72 and screwing the nuts 74. Further, the right and left lower rails 75 are coupled with the yoke member 90 by way of the fixing implements 78 and the lower coupling bodies 100 by communicating the slots 79 with the lower bolt holes 102, passing round head bolts 76 from sides of the slots 79, and screwing and caulking self-locking nuts 77 over protruding portions of the round head bolts 76.

At the coupling stage by way of the stud bolts 72 and the fixing implements 78 as described above, position adjusting members 99 and 104 are interposed at required locations between the upper rail 71 and the upper coupling body 95 (on a side of the yoke member 90), and between the lower rails 75 and the lower coupling bodies 100 (on the side of the yoke member 90).

The eighth embodiment which is configured to fix the rails 71 and 75 to the yoke member 90 by way of the upper coupling body 95 and the lower coupling bodies 100 permits simplifying a form of the yoke member 90, and allows the coupling bodies 95 and 100 to be coupled with the yoke member 90 easily and speedily, for example, by way of the fixing implements 98 and 103. Since the position adjusting members 99 and 104 having adequate required thickness (in a required quantity) are interposed at the stage to assemble the rail system 70, the eighth embodiment permits precisely adjusting a vertical spacing between the upper rail 71 and the lower rails 75 as well as a relative horizontal spacing between both the lower rails 75.

Finally, a ninth embodiment of the present invention will be described in various modes with reference to FIGS. 19(A) through 19(G).

Figure 19A:
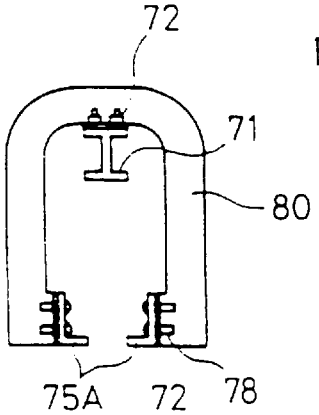
FIG. 19(A) through 19(G) are front views schematically showing a ninth embodiment, in various modes, of the rail system for carrier equipment according to the present invention.
Figure 19B:
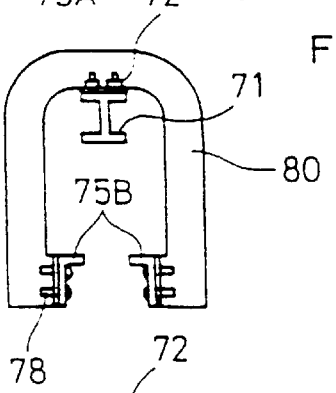

In FIG. 19(A), an upper rail 71 composed of an I-shaped member is coupled with stud bolts 72 and a pair of lower rails 75A composed of L-shaped members are coupled with fixing implements 78. In FIG. 19(B), an upper rail 71 composed of an I-shaped member is coupled with stud bolts 72 and a pair of lower rails 75B composed of inverted L-shaped members are coupled with fixing implements 78.

Figure 19C:
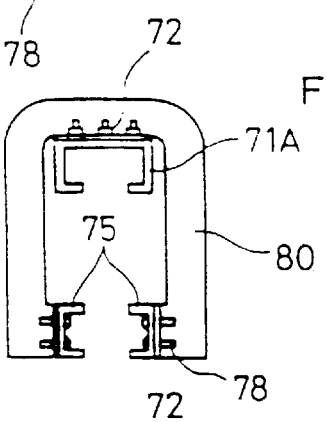
Figure 19D:
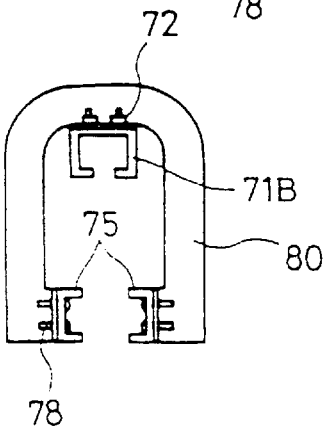

In FIG. 19(C), an upper rail 71A composed of a wide C-shaped member is coupled with stud bolts 72 and a pair of lower rails composed of C-shaped members are coupled with fixing implements 78. In FIG. 19(D), an upper rail 71B composed of a narrow C-shaped member is coupled with stud bolts 72 and a pair of lower rails 75 composed of C-shaped members are coupled with fixing implements 78.

Figure 19E:
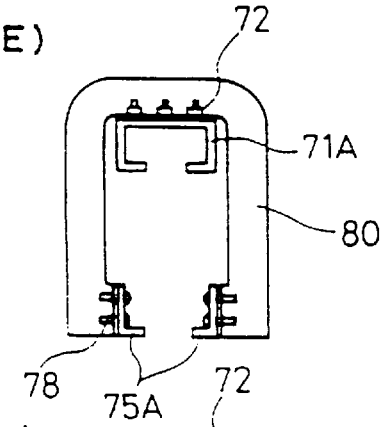
Figure 19F:
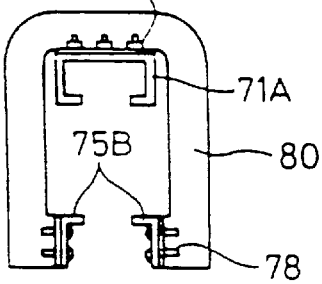

In FIG. 19(E), an upper rail 71A composed of a wide-C-shaped member is coupled with stud bolts 72 and a pair of lower rails 75A composed of L-shaped members are coupled with fixing implements 78. In FIG. 19(F), an upper rail 71A composed of a wide C-shaped member is coupled with stud bolts 72 and a pair of lower rails 75B composed of inverted L-shaped members are coupled with fixing implements 78. In FIGS. 19(E) or 19(F), an upper rail 71B composed of a narrow C-shaped member such as that shown in FIG. 19(D) may be coupled with the stud bolts 72.

Figure 19G:
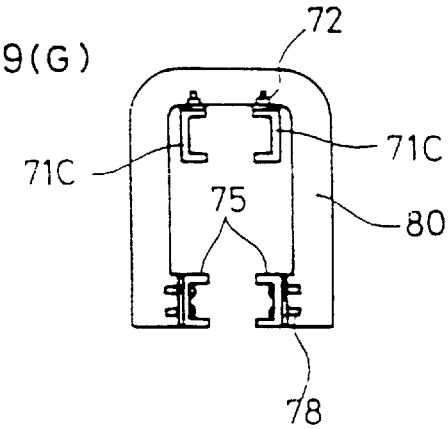

In FIG. 19(G), a pair of upper rails 71C composed of C-shaped members having openings opposed to each other are coupled with stud bolts 72 and a pair of lower rails composed of C-shaped members are coupled with fixing implements 78. In FIG. 19(G), a pair of lower rails 75A composed of L-shaped members or a pair of lower rails 75B composed of inverted L-shaped members such as those shown in FIGS. 19(A) or 19(B) may be coupled with the fixing implements 78.

Though the fixing implements which pass through the lower rails 75 for coupling these rails with the yoke member 80 consist of the round head bolts 76 and the self-locking nuts 77 in the seventh through ninth embodiments described above, these fixing implements may consist of ordinary bolts and nuts or rivets.

Though the driving body 50 using a chain is supported and guided by the upper rail 71 in the seventh through ninth embodiments described above, a moving force may be supplied to the trolley system 31 from an automotive body which is supported and guided by the upper rail 71.

Though the position adjusting members 99 and 104 are interposed between the upper rail 71 and the upper coupling bodies 95 in the eighth embodiment described above, and between the lower rails 75 and the lower coupling bodies 100, the position adjusting members 99 and 104 may be interposed between the upper rail 71 and the upper coupling pieces 81, and between the lower rails 75 and the lower coupling pieces 83.

Though the motion receiving body 40 is engaged and disengaged with and from the motion transmitting body 56 in the first or seventh embodiment described above, the motion transmitting body 56 may be engaged and disengaged with and from the motion receiving body 40.

What is claimed is:

1. A rail system for carrier equipment configured to couple rails by way of yoke members, wherein said yoke members are composed of planar plates in which slots are formed for coupling implements, and fixed to rail ends at locations where welding margins are left within end surfaces of rails, by welding which utilizes the welding margins, and wherein a pair of said yoke members having end surfaces of rails opposed to each other are coupled by way of said coupling implements passing through said slots for said coupling implements with intermediate members interposed for filling said welding margins.

2. A rail system for carrier equipment according to claim 1 wherein said intermediate members filling the welding margins are washers welded to said yoke members.

3. A rail system for carrier equipment according to claim 1 wherein said intermediate members filling the welding margins are spacers which are disposed between said yoke members for filling the welding margins.

4. A rail system for carrier equipment according to claim 1 wherein a plurality of said slots for the coupling implements are formed in said yoke members, and a plurality of said intermediate members are thick enough to fill said welding margins on both sides and welded distributedly to said yoke members.

5. A rail system for carrier equipment according to claim 1 wherein a plurality of said slots for said coupling implements are formed in said yoke members, and a plurality of said intermediate members are thick enough to fill said welding margins on both sides and welded to either of said yoke members.

6. A rail system for carrier equipment according to claim 1 wherein said rails consist of a first rail which supports and guides a driving body using a chain for supplying a moving force to a moving body, and second rails which support and guide said moving body, and said yoke members couple said rails.

7. A rail system for carrier equipment according to claim 6 wherein said first rail is composed of an I-shaped member disposed at an upper location, and said second rails are composed of a pair of C-shaped members which are located at lower locations and have openings opposed to each other.

8. A rail system for carrier equipment according to claim 6 wherein said second rails are composed of a pair of C-shaped members which are disposed at lower locations and have openings opposed to each other, and said yoke members have portions which protrude inward so as to be in contact with top surfaces of said second rails.

* * * * *